US008920466B2

(12) United States Patent
Marcus et al.

(10) Patent No.: US 8,920,466 B2
(45) **Date of Patent: *Dec. 30, 2014**

(54) ORAL STIMULATORY DEVICE FOR SOOTHING GUMS

(71) Applicant: LifeFactory, Inc., Sausalito, CA (US)

(72) Inventors: Pamela Wong Marcus, Kensington, CA (US); Daren Edward Joy, Sausalito, CA (US)

(73) Assignee: LifeFactory, Inc., Sausalito, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/906,300

(22) Filed: May 30, 2013

(65) Prior Publication Data

US 2014/0194928 A1 Jul. 10, 2014

Related U.S. Application Data

(63) Continuation of application No. 12/205,813, filed on Sep. 5, 2008, now Pat. No. 8,475,494.

(60) Provisional application No. 60/967,715, filed on Sep. 5, 2007.

(51) Int. Cl.
*A61J 17/02* (2006.01)

(52) U.S. Cl.
CPC ..... *A61J 17/02* (2013.01)
USPC ..... 606/235

(58) Field of Classification Search
CPC ... A01K 15/02; A01K 15/025; A01K 15/026; A61H 13/00; A61J 17/00; A61J 17/02
USPC ..... 119/702, 707, 709, 710; 606/234–236; D30/160
See application file for complete search history.

(56) References Cited

U.S. PATENT DOCUMENTS

| | | | |
|---|---|---|---|
| 5,649,964 | A | 7/1997 | Berman et al. |
| 5,766,223 | A | 6/1998 | Johnson |
| 2004/0267319 | A1 | 12/2004 | Stack |
| 2008/0208254 | A1 | 8/2008 | Berger et al. |
| 2009/0025423 | A1 | 1/2009 | Durham et al. |

*Primary Examiner* — Ryan Severson
(74) *Attorney, Agent, or Firm* — The Mueller Law Office, P.C.

(57) ABSTRACT

An oral stimulatory device is configured for soothing gums, for instance, the gums of a teething infant. Accordingly, in one embodiment, the oral stimulatory device includes a tubular body. In certain embodiments, the tubular body is configured for being at least partially positioned in an oral cavity of a user, such as an infant, and is adapted for being deformed. Although the oral stimulatory device may be fabricated from any suitable material, in certain embodiments, the tubular body of the oral stimulatory device is fabricated from a material comprising silicone. In certain embodiments, the oral stimulatory device includes at least one stimulatory element, for example, a plurality of stimulatory elements, which elements may be adapted for soothing the gums of an infant when positioned in an oral cavity (e.g., mouth) of the infant.

19 Claims, 4 Drawing Sheets

ORAL STIMULATORY DEVICE FOR SOOTHING GUMS

RELATED APPLICATIONS

This application is a continuation of U.S. patent application Ser. No. 12/205,813, filed on Sep. 5, 2008 now U.S. Pat. No. 8,475,494 and entitled "Oral Stimulatory Device For Soothing Gums"; which claimed the benefit under 35 U.S.C. Section 119(e) of U.S. Provisional Patent Application No. 60/967,715, filed on Sep. 5, 2007 and entitled "Oral Stimulatory Device For Soothing Gums"; which are both incorporated by reference herein in their entirety.

BACKGROUND OF THE INVENTION

In many instances, the teething process whereby an infants' growing teeth break through their gums is often a difficult and painful process for the infant. In such instances, the parent(s) of the infant may provide the infant with a teether device which the infant may place in their mouth and next to their gums, so as to be able to suck and/or chew on the teether in an effort to sooth the gums and facilitate the teething process. There are, however, several problems with the teethers that are currently available.

For instance, the teethers currently available are often made from various plastic materials. Recently, however, there has been a large amount of publicity regarding the various dangers related to the chemical constituents of the plastics from which teethers have been made. Specifically, various chemical constituents from which plastic teethers are typically made, e.g., bisphenol A and/or phthalates, may leach out of the plastic and possibly into the mouth of the teething infant. This problem is of special concern with regard to infants because bisphenol and/or phthalates, which may leak from the plastic teether into the mouth of an infant or child, may mimic the growing child's endogenous hormones and are, therefore, considered harmful to growing infants and children.

Accordingly, there is a need in the art for a device that will allow a user to ease the teething process and/or sooth their gums and yet avoid the possible hazards presented by the leaching of harmful chemical constituents out of the device that may result from the degradation of the plastics typically used in the manufacture of such devices. The present invention meets these and other such needs.

SUMMARY OF THE INVENTION

Aspects of the invention includes an oral stimulatory device. In certain embodiments, the oral stimulatory device is configured for soothing gums, for instance, the gums of a teething infant. Accordingly, in one embodiment, the oral stimulatory device includes a tubular body. In certain embodiments, the tubular body is configured for being partially positioned in an oral cavity of a user, such as an infant, and is adapted for being deformed. Although the oral stimulatory device may be fabricated from any suitable material, in certain embodiments, the tubular body of the oral stimulatory device is fabricated from a material comprising silicone. For instance, in one embodiment, the tubular body comprises a material that is at least about 50%, that is at least about 60%, that is at least about 70%, that is at least about 80%, that is at least about 90%, such as 95%, or even 99% food grade silicone. In certain embodiments, the oral stimulatory device includes at least one stimulatory element, for example, a plurality of stimulatory elements, which elements may be adapted for soothing the gums of an infant when positioned in an oral cavity (e.g., mouth) of the infant.

BRIEF DESCRIPTION OF THE DRAWINGS

According to common practice, the various features of the drawings may not be drawn to-scale. Rather, the dimensions of the various features may be arbitrarily expanded or reduced for clarity. Included in the drawings are the following figures.

Figure 1:
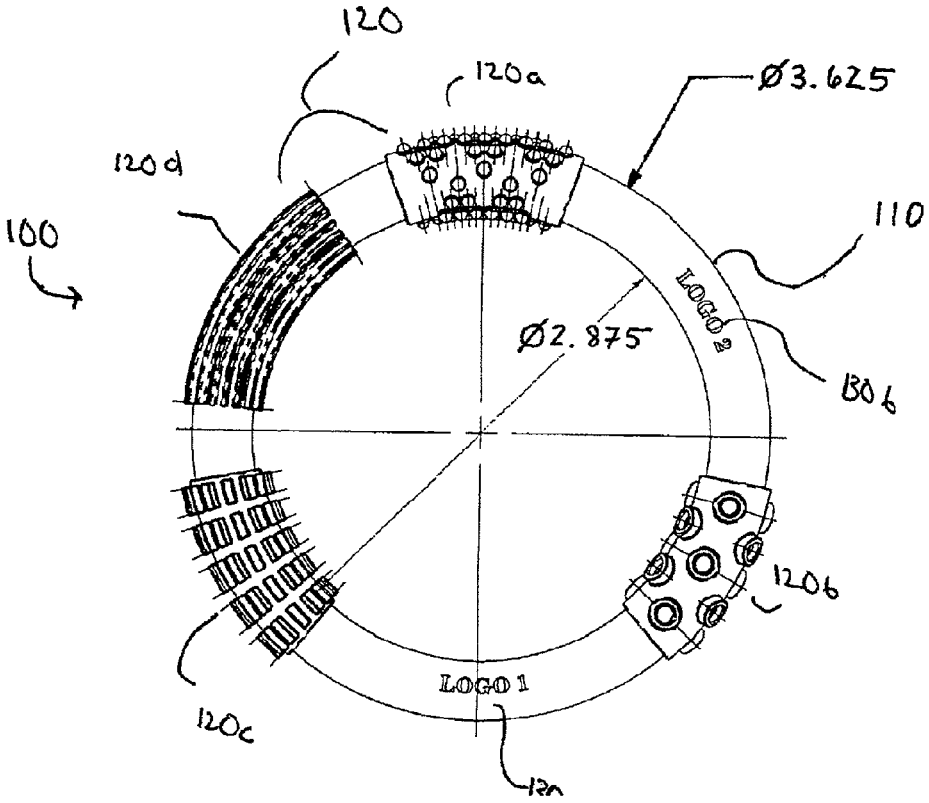
FIG. 1 illustrates an embodiment of an oral stimulatory device comprising a tubular body and a plurality of stimulatory elements in accordance with the invention.

Before the present invention is further described, it is to be understood that this invention is not limited to particular embodiments described, as such may of course vary. It is also to be understood that the terminology used herein is for the purpose of describing particular embodiments only, and is not intended to be limiting. Unless defined otherwise, all technical and scientific terms used herein have the same meaning as commonly understood by one skilled in the art to which this invention belongs.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

Throughout this application, various publications, patents and published patent applications are cited. The disclosures of these publications, patents and published patent applications referenced in this application are hereby incorporated by reference in their entirety into the present disclosure. Citation herein by the Applicant of a publication, patent, or published patent application is not an admission by the Applicant of said publication, patent, or published patent application as prior art.

It must be noted that as used herein and in the appended claims, the singular forms "a", "and", and "the" include plural referents unless the context clearly dictates otherwise. Thus, for example, reference to a "bump" or "ridge" may include a plurality of such bumps or ridges, and reference to "the stimulatory element" includes reference to one or more stimulatory elements and equivalents thereof known to those skilled in the art, and so forth. It is further noted that the claims may be drafted to exclude any optional element. As such, this statement is intended to serve as antecedent basis for use of such exclusive terminology as "solely", "only" and the like, in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

DETAILED DESCRIPTION

Aspects of the invention include an oral stimulatory device. In certain embodiments, the oral stimulatory device is configured for soothing gums, for instance, the gums of a teething infant. Accordingly, in one embodiment, the oral stimulatory device includes a tubular body. In certain embodiments, the tubular body is configured for being partially positioned in an oral cavity of a user, such as an infant, and is adapted for being deformed.

Although the oral stimulatory device may be fabricated from any suitable material, in certain embodiments, the tubular body of the oral stimulatory device is fabricated from a material comprising silicone. For instance, in one embodiment, the tubular body comprises a material that is at least about 50%, that is at least about 60%, that is at least about 70%, that is at least about 80%, that is at least about 90%, such as 95%, or even 99% food grade silicone.

In certain embodiments, the oral stimulatory device includes at least one stimulatory element, for example, a plurality of stimulatory elements, which elements may be adapted for soothing the gums of an infant when positioned in an oral cavity (e.g., mouth) of the infant.

Oral Stimulatory Devices

As summarized above, the subject invention provides an oral stimulatory device, such as a teether and/or pacifier, which device may include oral and/or motor stimulatory elements for promoting the development of the user. In certain embodiments, the device is a teether or pacifier that may be configured for soothing the gums and/or pacifying the user, e.g., by providing the user with a deformable surface which may be chewed and sucked on in a manner sufficient to give comfort and/or ease the pain associated with teething, anxiety, and the like. By "soothing" or "pacifying" is meant that an oral stimulatory device of the subject invention is capable of minimizing, or at least decreasing, the pain associated with teething, anxiety, separation, hunger, or any other form of discomfort that an infant or child may suffer from and which may be soothed by positioning a device of the subject invention in the oral cavity (e.g., mouth) of the user, which device may then be chewed, sucked on, and/or otherwise manipulated in such a manner that the pain, whether emotional or physical, is eased.

In certain embodiments, the oral stimulatory device of the subject invention includes a tubular body that is configured for being positioned in the oral cavity (e.g., mouth) of a user. For instance, in certain embodiments, the tubular body is configured for being partially and/or entirely positioned in the mouth. In other embodiments, the tubular body is configured for at most being partially positioned in the mouth. For instance, in certain embodiments, the tubular body is configured for being partially positioned in the mouth of a user and yet also configured for not being entirely positioned or otherwise fitted therein. Specifically, in certain embodiments, the oral stimulatory device of the subject invention may be a teether that includes a tubular body that is configured for being partially but not fully (e.g., entirely) positioned in the mouth. In certain embodiments, the oral stimulatory device of the subject invention may be a pacifier that includes a tubular body that is configured for being partially and/or fully (e.g., entirely) positioned in the mouth.

In certain embodiments, the tubular body of a device of the subject invention is pliable and/or configured for being deformable. By "deformable" is meant that the shape or form of the tubular body is capable of being changed or altered by the application of a force, pressure, stress or the like. For instance, in certain embodiments, the shape of the tubular body is configured for being deformed by the gums, teeth, tongue, and/or mouth of an infant such that the tubular body gives, compresses and/or bends in response to a force applied to the tubular body by the gums, teeth, tongue and/or mouth of the infant or child, such as by the infant chewing, sucking on, or otherwise manipulating the tubular body within the mouth. In certain embodiments, the shape of the tubular body is configured for being deformed by one or more hands or feet of the infant and/or one or more hands, feet and/or the mouth of the infant acting in concert to push, pull, and/or stretch the tubular body in such a manner that its shape is deformed in some appreciable and detectable manner.

For instance, teethers, as are known in the art, are often fabricated from a stiff, hard plastic or other such material that does not appreciably give and/or deform. In such an instance, although the material from which the teether is fabricated may give slightly in response to a significantly applied force, the material and/or body is not designed to be pliable and will not appreciably give. Hence, teethers made from such materials will be stiff and will not provide the soothing effect indicative of the oral stimulatory devices of the subject invention. Hence, by "appreciable" or "appreciably" is meant that the tubular body of a device of the subject invention may deform to an extent that may be both noticeable and significant so as to evoke a stimulatory and/or soothing effect in the user. Further, a characteristic of the deformable tubular body of a device of the subject invention is that once the applied deforming force is removed the tubular body resumes its original, non-deformed configuration. Hence, because the tubular body is flexible, it allows an infant to develop its hand/eye coordination and muscles be deforming the flexible body thereby sharpening the infants coordination and strengthening the infants muscles.

In certain embodiments, the oral stimulatory device of the subject invention includes a stimulatory element that is adapted for being positioned in the oral cavity (e.g., mouth) of a user and soothing or otherwise stimulating the gums or tongue when positioned within said oral cavity and contacted with the gums, tongue and/or teeth therein. By "stimulating" is meant that the stimulatory element is adapted for being contacted with and/or manipulated by the gums, tongue and/or teeth in a manner sufficient to produce an excitatory effect in the user. For instance, by manipulating one or more of the stimulatory elements, a user experiences a sensation that excites increased activity, growth and/or positive change. By "soothing" is meant that stimulatory element is adapted for being contacted with and/or manipulated by the gums, tongue and/or teeth in a manner sufficient to produce a calming effect in the user. For instance, by manipulating one or more of the stimulatory elements, a user experiences a sensation (e.g., touch, sound, taste, etc.) that relieves tension, anxiety, pain or other aching-type sensation.

Hence, unlike teethers or pacifiers known in the art that do not include such stimulatory surface elements, the stimulatory elements of the oral stimulatory device of the subject invention may be configured for providing a user with a multi-sensory awareness of the experiences of touch, sound, taste, or the like, as the user explores the surface qualities provided to the device by the stimulatory elements with the face, mouth, gums, tongue, hand(s) and/or feet. Specifically, the stimulatory elements may be adapted such that the child's speech development is promoted by exploring the stimulatory elements with the tongue, lips, and/or mouth of the infant. Additionally, the varied textures of the surface element(s)

may make an auditory sound or vibratory feel when they are manipulated by the mouth, tongue, or hands, etc., which the infant may find stimulating and pleasant.

In certain embodiments, a single or plurality of stimulatory elements may be provided. Additionally, each stimulatory element may include one or a plurality of individual shapes, designs, elements, or the like, the collection of which composes the stimulatory element. The stimulatory elements may have any suitable shape so as to stimulate and/or sooth a user. For instance, a stimulatory element may be configured as one or a plurality of nubs, bumps, ridges, circles, squares, triangles, ellipses, raised letters, or the like. For example, in certain embodiments, one, two, three, four, five, or more stimulatory elements are provided, wherein each stimulatory element includes one or more shapes (e.g., sub-elements). Specifically, in certain embodiments, an oral stimulatory device includes one, two, three, or four stimulatory elements, which each include a plurality of sub-elements configured as nubs, bumps, ridges and circles. In certain embodiments, the stimulatory element includes one or more raised letters. The stimulatory elements may be positioned randomly along the tubular body or may be placed at a specific position on the tubular body, for instance, equidistant from one another.

In certain embodiments, an oral stimulatory device of the subject invention, including one or more of its components, such as the tubular body and/or one or more stimulatory elements, may be fabricated from any suitable material that evidences an elastic property. By "elastic property" is meant that the material is capable of being stretched, compressed and/or otherwise manipulated by the application of a force and yet spontaneously resume its normal and original configuration or shape once the applied force is withdrawn.

Accordingly, an oral stimulatory device, and/or components thereof, of the subject invention, may be constructed in any manner from any suitable material well known in the art, usually including those used in the fabrication industry for the manufacture of teethers and/or pacifiers. In certain embodiments, a suitable material is a material that does not include any harmful chemical constituents that may leach from the material and possibly be ingested when the oral stimulatory device is contacted with a mouth of a user. Accordingly, in certain embodiments, the material from which the oral stimulatory device is made is not a plastic material. In certain embodiments, the material is an FDA approved material that may be scent and/or taste free.

In certain embodiments, not only does the material not include harmful chemical constituents that may leach out of the material, the material is also FDA approved, and/or the material is capable of withstanding high temperatures, for instance, temperatures up to about 100° C., or up to about 400° C., up to about 600° C., even up to about 800° C. or more. For example, in certain embodiments, the material is capable of being placed in a boiling liquid, e.g., water, or dishwasher, or the like, and withstanding the high temperatures therein without being adversely effected. In certain embodiments, the material is capable of withstanding low temperatures and not becoming brittle, for instance, low temperatures such as about 0° C., about −5° C., such as about −10° C., including −15° C., and the like. For example, in certain embodiments, the material is capable of being placed in a refrigerator or freezer, or the like, and withstanding the low temperatures therein without being adversely effected (e.g., becoming too rigid to be comfortably used by an infant or child).

Accordingly, in certain embodiments, a suitable material, may be one or more of an elastic material, rubber, polyurethane, silicone, and/or a silicone containing material. In certain embodiments, an oral stimulatory device of the invention includes a polymerized siloxane such as silicone. For instance, in certain embodiments, the oral stimulatory device is compression or liquid injection molded as a single continuous piece from a precursor material that is up to 50%, up to 60%, up to 70%, up to 80%, up to 85%, up to 90%, up to 95%, up to 99%, or more and including up to 100% silicone. The silicone to be used in the fabrication of a device of the subject invention may be obtained from any suitable source such as that provided by GE™ or Dow Corning™.

Hence, in certain embodiments, an oral stimulatory device of the subject invention and the material from which it is fabricated is hygienic, light weight and flexible such that the material is capable of being stretched, compressed, or otherwise deformed, so as to allow the tubular body and/or stimulatory element(s) thereof, to be moved from a first, normal position to a second, deformed position in response to an exerted stimulus (e.g., a pulling, pushing, or stretching force), and yet resilient enough to return to the first, normal position after the stimulus is removed. Hence, in certain embodiments, the oral stimulatory device and the material from which it is fabricated is capable of being compressed or stretched from its original configuration, e.g., by the application of a chewing force applied by the gums, teeth, tongue and/or mouth of a user, and yet configured for returning to its original configuration once the chewing or stretching force is removed.

In certain embodiments, the oral stimulatory device is fabricated from a single piece of shaped or otherwise molded material (e.g., food grade silicone) that has elastic properties, such that the oral stimulatory device can deform to provide a stimulatory or soothing effect, and then reform to its original configuration automatically, that is without the need for external manipulation. For instance, in certain embodiments, the tubular body and/or stimulatory elements thereof, is fabricated from a silicone material that includes durometer in the range of about 20 to about 100, including about 40 to about 80, such as from about 45 to 65.

Accordingly, in certain embodiments, the oral stimulatory device is configured to not only provide oral soothing but may also provide oral, physical and/or mental stimulation by the material from which it is made and the inclusion of one or more stimulatory elements. For instance, the size, shape, diameter, durometer, stretchiness, and/or configuration of the tubular body and/or stimulatory elements included thereon is adapted so as to promote the growth and/or development of the infant, child, or user of the device. Specifically, in certain embodiments, the size, diameter and weight of the device has been specifically configured so as to optimally fit the size of an infants hand and allow for a prolonged and easy grip of the device, such that an infant can easily grasp and hold the device for a prolonged period of time such as from about 30 seconds or 1 minute to about multiple hours or more, such as from about 5 minutes to about an hour, including about 10 minutes to about 40 minutes, including about 20 to about 30 minutes. Additionally, the durometer of the material from which the tubular body is made, e.g., silicone, is selected so as to allow the tubular body to be stretched and deformed by manipulation with one or both of the child's hands, and thereby strengthening the infant or child's grip, arm muscles, joints, and stimulating the child's brain. Further, the pliability of the material (e.g., food grade silicone) may be adapted so as to allow the child to deform and/or chew the tubular body or a stimulatory element thereof, without causing the child discomfort due to too rigid a surface. In this manner, the infant can derive satisfaction from biting into or chewing on the oral device.

An oral stimulatory device of the subject invention may have any suitable shape. For instance, in certain embodiments, the device includes a tubular body that has a circular shape, ring shape, square shape, triangular shape, rectangular shape, pentagonal shape, hexagonal shape, octagonal shape, elliptical shape, pyramidal shape, round shape, figure eight shape, for instance, where one ring is larger than the other, or the like. For example, in certain embodiments, the tubular body of the oral stimulatory device includes a circular or ring shape, wherein circular or ring shape defines both a circular outer and interior space.

Accordingly, in certain embodiments, the ring or circular shaped device includes an interior diameter and weight that is configured so as to allow the device to comfortably fit within the grasp of an infant whose age is from about 2 months to about 10 months. For instance, in one embodiment, the circular interior space is of a size that is adapted to be slipped over an infant's hand. Specifically, in certain embodiments, the circular interior space may include a diameter from about 1 inch or less to about 5 inches or more, including about 2 to about 4 inches, such as about 3 inches. In certain embodiments, the outer diameter of the circular or ring shaped device includes a range from about 1.5 inches to about 6.5 inches, including about 2.5 inches to about 4.5 inches, such as from about 3.25 inches to about 4.25 inches in diameter.

In certain embodiments, the oral stimulatory device of the subject invention has a weight that ranges from about 5 grams or less to about several hundred grams or more, such as about 10 grams to about 500 hundred grams, including about 25 grams to about 250 grams, such as about 50 grams to about 100 grams. In certain embodiments, the oral stimulatory device is configured to be held and/or gripped by one and/or two hands of an infant and/or child. Accordingly, in certain embodiments, the tubular body has a cross sectional diameter that is in the range of about 1/10 inch or less to about 2 inches or more, including about ¼ inch to about 1 inch, such as about ⅜ inch to about ¾ inch, including about ½ inch.

In certain embodiments, the oral stimulatory device and/or a tubular body thereof, may be fabricated from a single piece of material and may include a lumen, for instance, a lumen that is hollow or may be filled with a fluid. Accordingly, in certain embodiments, the tubular body of the oral stimulatory device includes a lumen that includes a fluid, such as a liquid, gas; or a solid, semi-solid, or gel. For instance, in certain embodiments, the tubular body includes a lumen that is filled or partially filled with a liquid. Any suitable biocompatible and/or food grade solid, liquid or gel may be used, and in one embodiment, the liquid is water. In certain embodiments, the oral stimulatory device and/or a tubular body thereof, is configured in such a way so that a liquid, gel, or solid material may be added or removed from the lumen of the tubular body (if included). Accordingly, in this embodiment, the device may include a nozzle, stem, or the like, for the introduction and removal of a material in to the lumen of the tubular body.

In certain embodiments, the tubular body of the oral stimulatory device does not include a lumen, but rather includes a solid core and/or is solid throughout its cross sectional diameter. For example, where it may be desired, the tubular body may be solid, for instance, where the leakage of a material from a lumen of a tubular body is a potential risk or otherwise undesirable, the tubular body may be solid, thereby alleviating such a risk or undesired consequence; or where it may be desired to promote the ease of washing without fear of puncturing the tubular body and releasing any fluid contained therein.

In certain embodiments, the oral stimulatory device additionally includes a noise making, light and/or vibratory element. For instance, the noise and/or vibrating element may be an integral part of the tubular body and be a molded part thereof which may be manipulated by the mouth or hands and thereby evoke a noise, or the noise making and/or vibratory element may be a battery operated electronic element inserted into the interior of the tubular body and configured for producing a noise, light or vibration. For example, in certain embodiments, the device includes a pressure sensitive noise making, lighting and/or vibratory element that makes a noise and/or emits a light and/or vibrates when a pressure is supplied to the tubular body or a stimulatory element thereon.

In certain embodiments, an oral stimulatory device of the subject invention includes a gripping element. For instance, in certain embodiments, the tubular body includes one or more gripping elements, such as, but not limited to: an indentation, a groove, ribbing, and a raised surface element. In one embodiment, a component of the tubular body includes a raised or indented surface element, wherein the raised or indented surface element may be, for example, one or more letters, words, sentences, designs, shapes, or other such figures that are formed within or otherwise associated with a component of the tubular body. Specifically, the raised or indented surface element may not only serve the purpose of enhancing gripping but may also be used to communicate one or more meanings to a user. For instance, the device may include one or more raised or indented surface elements that communicate a name, logo, word or phrase, such as "comfort" or "BABYLIFE"™.

In certain embodiments, the oral stimulatory device and/or one or more of the components thereof includes one or more identifying colors. Any single color or a mixture of colors may be used. For instance, the one or more colors of the device may be one or more of red, yellow, blue, medium blue, raspberry, or the like. In certain embodiments, the oral stimulatory device is tinted with a food grade colorant, and in other embodiments, the device does not have an additional color but rather retains the color of the material from which it is made. In certain embodiments, the oral stimulatory device or its components, is translucent or see-through. In certain embodiments, the oral stimulatory device comprises a material that changes color. For instance, in certain embodiments, the device includes a material that changes color when exposed to an environmental stimulus, such as sunlight, temperature, pressure, or the like.

In certain embodiments, an oral stimulatory device of the subject invention includes a shield or attachment portion and/or may include a handle portion. In certain embodiments, the shield portion is configured for both contacting and holding the tubular body and for engaging an outside portion of the mouth so as to prevent or shield the tubular body portion from being swallowed. The shield portion may have any suitable configuration, for instance, it may be circular, semi-circular, elliptical, bean shaped, round, and the like, so long as it is configured to comfortably engage the exterior portions of a users mouth and/or lips. The handle portion, if included, may be adapted for being grasped by the user or another and thereby manipulated. In certain embodiments, an attachment member including an extended member and/or attachment end (e.g., a clip or the like) may be attached to the handle and configured for attaching the attachment end to a distal element not associated with the oral stimulatory device, such as an article of clothing.

Figure 2:
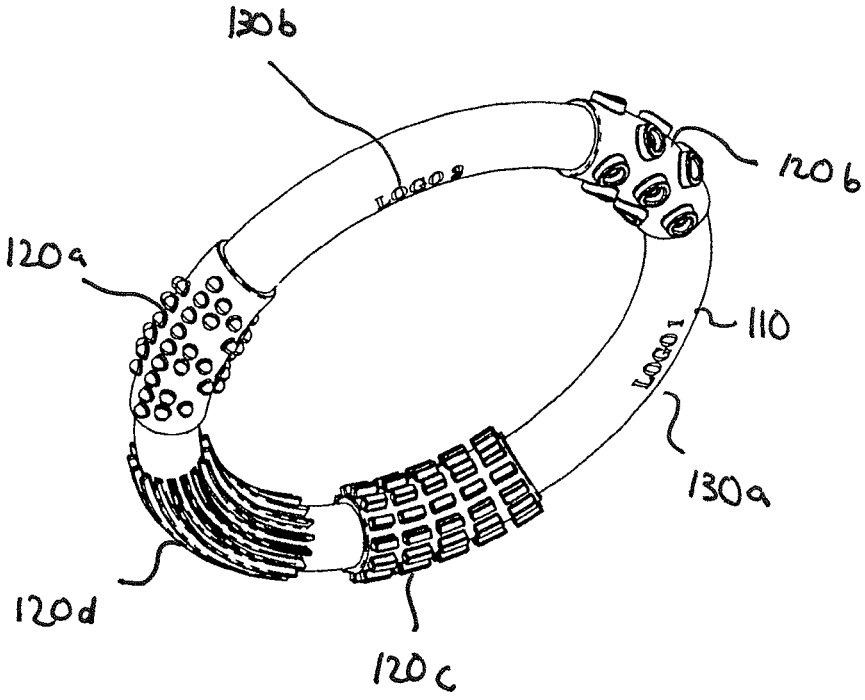
FIG. 2 illustrates a perspective view of another embodiment of an oral stimulatory device in accordance with the invention.
Figure 3:
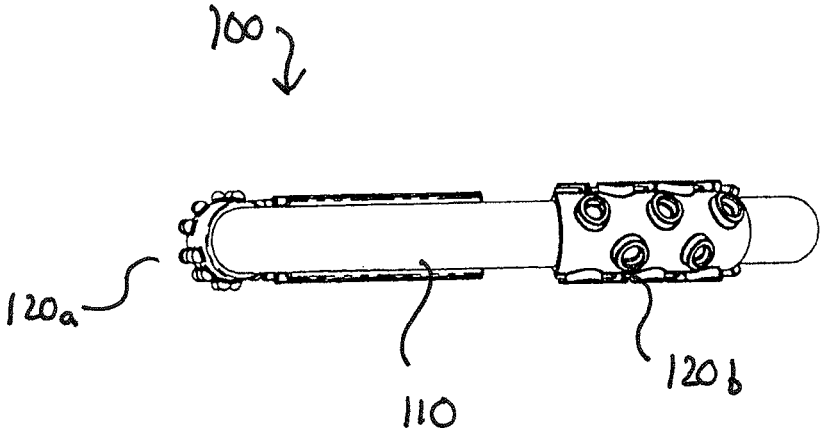
FIG. 3 illustrates a side view of another embodiment of an oral stimulatory device in accordance with the invention.
Figure 4:
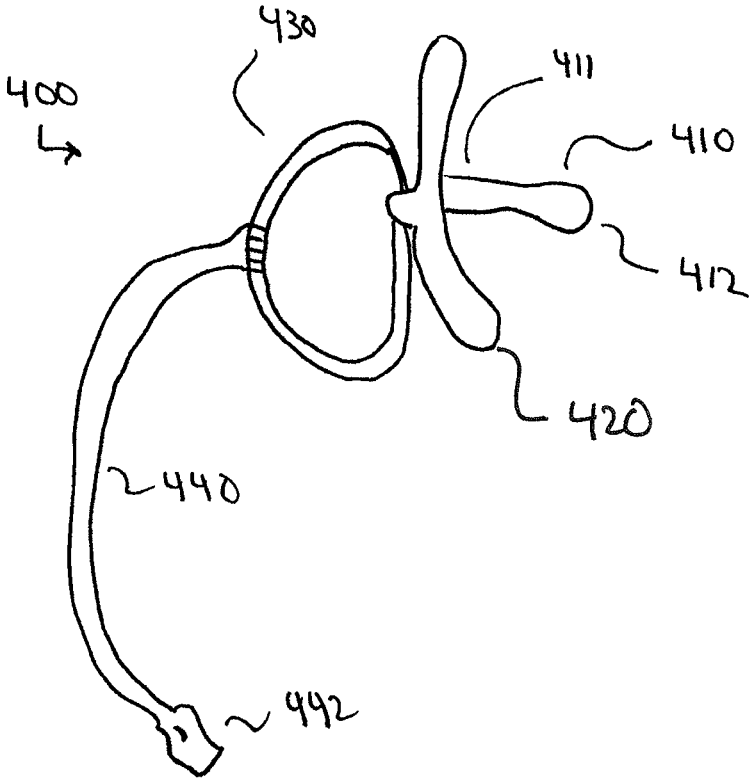
FIG. 4 illustrates a side view of another embodiment of an oral stimulatory device in accordance with the invention.

Various embodiments of the subject invention will now be described with reference to the figures. For clarity and convenience, the oral stimulatory device is exemplified in FIGS. 1-3, herein below as a teether ring. However, as described above, other embodiments of oral stimulatory devices are contemplated by the invention, such as a pacifier (See FIG. 4). FIG. 1 shows a front view, FIG. 2 shows a perspective view, and FIG. 3 shows a side view of an exemplary oral stimulatory device according to an illustrative, but non-limiting embodiment of the present invention. FIG. 4 shows a side view of a pacifier in accordance with the subject invention.

As can be seen with reference to FIG. 1, in certain embodiments, an oral stimulatory device (100) of the subject invention includes a tubular body (110) that is configured for being partially positioned within an oral cavity of a user, such as a mouth of an infant. As illustrated the oral stimulatory device (100) includes a plurality of stimulatory elements (120), which are adapted for soothing gums when positioned within said oral cavity.

As illustrated, the oral stimulatory device (100) includes a plurality of stimulatory elements (120*a-d*). The stimulatory elements (120) include a plurality of circles, nubs, bumps, and ridges (120*a-d*, respectively). The oral stimulatory device (100) is configured as a teether, wherein only a portion of the tubular body (110) may be fit into the mouth of a user. The dimensions of the tubular body, e.g., its weight, interior and exterior diameter, as well as its cross-sectional diameter are specifically configured to allow ease of grip and prolonged periods of comfortable holding for an infant of about 2 months of age or older. Additionally, the stimulatory elements (120*a-d*) are specifically designed and spaced to provide an optimal sensory experience when a user touches them with the hand(s), mouth, lips, tongue, teeth and/or gums of the user. The durometer of the material from which the tubular body is made is also selected so as to provide an optimal stretchiness of the device, which stretchiness allows the device to be deformed and stretched or compressed by the user thereby promoting the hand/eye coordination and strength of the user.

As can be seen with respect to FIG. 1, gripping elements (130 *a* and b) may also be included in the form of letters which form words, such as the word or logo as shown. As described above, the oral stimulatory device of the invention may be made out of any suitable material, however, in certain embodiments, such as that illustrated in FIG. 1, the device is fabricated from silicone, e.g., molded from a single piece of 100% silicone.

FIG. 2 sets forth a perspective view and FIG. 3 sets forth a side view of the device of FIG. 1.

As can be seen with reference to FIG. 4, in certain embodiments, an oral stimulatory device (400) of the subject invention includes a tubular body (410) that is configured for being partially or entirely positioned within an oral cavity of a user, such as a mouth of an infant. The tubular body (410) may be concave, convex, or uniform, and may include a distal portion (412) with a bulb type configuration. As illustrated, the tubular body (410) does not include a stimulatory element, but one or more of such elements may be included if desired.

As illustrated the oral stimulatory device (400) also includes a shield portion (420), which shield portion is configured for engaging a proximal portion (411) of the tubular body (410), and also configured for contacting a mouth, lip, or facial portion of a user. The shield portion may be made out of any suitable biocompatible material such as a more rigid form of silicone or a safer polyethylene glycol or non-leaching plastic material. The device further includes a handle element (430) which is connected to an extended attachment element (440) that includes a clip (442). As described above, the tubular element of oral stimulatory device of the invention may be made out of any suitable material, however, in certain embodiments, such as that illustrated in FIG. 4, the tubular element is fabricated from silicone, e.g., molded from a single piece of 100% silicone.

All publications and patents cited in this specification are herein incorporated by reference as if each individual publication or patent were specifically and individually indicated to be incorporated by reference.

While the invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the invention. All such modifications are intended to be within the scope of the claims appended hereto.

What is claimed is:

1. An oral stimulatory device comprising:

a single tubular body configured for being at least partially positioned within an oral cavity of a user and capable of being deformed;

wherein a surface of the tubular body comprises a plurality of differently shaped stimulatory elements unevenly spaced along the tubular body and adapted for soothing gums when positioned within the oral cavity.

2. The device of claim 1 wherein the tubular body is fabricated from a material comprising silicone.

3. The device of claim 1 wherein the tubular body is fabricated from a material with a durometer in the range of about 20 to about 100.

4. The device of claim 3 wherein the durometer is chosen such that the tubular body has a flexibility to strengthen muscles of an infant.

5. The device of claim 1 wherein the tubular body is configured to be deformed from an initial non-deformed shape to a deformed shape upon the application of a force to the tubular body, and resuming the initial non-deformed shape upon the removal of the force.

6. The device of claim 1 further comprising a shield coupled to the tubular body, wherein the shield is configured to engage an outside portion of the mouth.

7. The device of claim 6 wherein the device is a pacifier.

8. The device of claim 6 further comprising a handle coupled to the shield.

9. The device of claim 1 further comprising a handle coupled to the tubular body.

10. The device of claim 1 wherein the surface of the tubular body is concave, convex, or uniform.

11. The device of claim 1 wherein the tubular body further comprises a bulb configuration at a distal portion of the tubular body.

12. The device of claim 1 wherein the tubular body is toroidal.

13. The device of claim 1 wherein the tubular body comprises a shape selected from circular, square, rectangular, and elliptical.

14. The device of claim 1 wherein the plurality of stimulatory elements comprise a configuration selected from the group consisting of nubs, bumps, ridges, circles, squares, triangles, ellipses, and raised letters.

15. The device of claim 1 wherein the tubular body further comprises at least one of a noise making element, a light element, and a vibratory element.

16. The device of claim 1 wherein the tubular body comprises one or more identifying colors.

17. The device of claim 16 wherein the color changes when exposed to an environmental stimulus.

18. The device of claim 1 wherein the tubular body comprises a solid cross-section.

19. The device of claim 1 wherein the tubular body comprises a lumen.

* * * * *